US007704101B2

(12) United States Patent
Nagata et al.

(10) Patent No.: US 7,704,101 B2
(45) Date of Patent: Apr. 27, 2010

(54) ELECTRIC CONNECTOR

(75) Inventors: Takayuki Nagata, Yao (JP); Hayato Kondo, Yao (JP)

(73) Assignee: Hosiden Corporation, Yao-shi (JP)

( * ) Notice: Subject to any disclaimer, the term of this patent is extended or adjusted under 35 U.S.C. 154(b) by 0 days.

(21) Appl. No.: 12/145,087

(22) Filed: Jun. 24, 2008

(65) Prior Publication Data

US 2009/0017693 A1 Jan. 15, 2009

(30) Foreign Application Priority Data

Jul. 13, 2007 (JP) ..... 2007-184285

(51) Int. Cl.
*H01R 24/00* (2006.01)

(52) U.S. Cl. ..... 439/660; 439/79; 439/80

(58) Field of Classification Search ..... 439/79, 439/80, 660

See application file for complete search history.

(56) References Cited

U.S. PATENT DOCUMENTS 4,802,860 A * 2/1989 Kikuta ..... 439/79
5,591,035 A * 1/1997 Burkholder et al. ..... 439/79
5,926,377 A * 7/1999 Nakao et al. ..... 361/763
6,969,268 B2 * 11/2005 Brunker et al. ..... 439/108
7,549,895 B2 * 6/2009 Kondo et al. ..... 439/579
7,611,361 B2 * 11/2009 Kondo et al. ..... 439/79
2005/0148218 A1 * 7/2005 Fang et al. ..... 439/79
2006/0141826 A1 * 6/2006 Olson et al. ..... 439/79

FOREIGN PATENT DOCUMENTS

JP 2005-293970 A1 10/2005

* cited by examiner

*Primary Examiner*—Renee Luebke
*Assistant Examiner*—Larisa Tsukerman
(74) *Attorney, Agent, or Firm*—Kratz, Quintos & Hanson, LLP

(57) ABSTRACT

An electric connector includes: an insulating body, having holes aligned in a widthwise direction thereof at an equal pitch distance in a plurality of levels shifted in phase and spaced apart from one another in correspondence with contacts of a mating connector; a plurality of levels of contact groups, each including L-shaped contacts with tip end sides thereof being received and retained in the holes and base end sides thereof being disposed along a rear face of the body, lead portions at rear ends of the contacts being aligned in a line in the widthwise direction at a pitch distance t; and a dielectric spacer, disposed in a blank region on the rear face of the body, the blank region being defined by adjacent ones of the contacts with base end sides thereof spaced apart at a distance "n×t," the n being an integer not smaller than two.

10 Claims, 13 Drawing Sheets

(a)

(b)

ELECTRIC CONNECTOR

The present application claims priority under 35 U.S.C. §119 of Japanese Patent Application No. 2007-184285 filed on Jul. 13, 2007, the disclosure of which is expressly incorporated by reference herein in its entity.

BACKGROUND OF THE INVENTION

1. Field of the Invention

The present invention relates to an electric connector mainly used in digital signal transmission at a high speed and optimal for impedance matching with high accuracy.

2. Description of the Related Art

There are transmission systems of an unbalanced (single-end) type and of a differential type, which have been conventionally used in electric signal transmission at a high speed. In the unbalanced type, each signal path employs one signal line, the respective paths share one common ground line, and a voltage of the signal line is transmitted as a signal with a ground regarded as a reference. On the other hand, in the differential type, each signal path employs two signal lines, and a difference in voltage between the two lines is transmitted as a signal. The differential type is not responsive to signals such as electromagnetic noise, which are applied equally to its two signal lines, because voltages of the two signal lines are equal in amplitude and different from each other in phase by 180 degrees. Therefore, in comparison to the unbalanced type, the differential type is more sustainable with respect to noise and is suitable for transmission at a high speed.

FIG. 12 illustrates one example of an electric connector which is used in such a transmission system of the differential type. A body 500 is provided with terminal receiving holes 510, and upper and lower contacts 600*a* and 600*b* are respectively inserted into and retained by the terminal receiving holes 510. The upper and lower contacts 600*a* and 600*b* are arranged in a zigzag shape in a widthwise direction of the body 500, and base ends thereof are led out of a rear face of the body 500 and are substantially orthogonally bent downwards so as to be attached to an external circuit board (not shown).

Each of the upper and lower contacts 600*a* and 600*b* has a main portion to be inserted into one of the terminal receiving holes 510 of the body 500, a linking portion provided continuously from a rear end of the main portion to be substantially orthogonally bent along the rear face of the body 500, and a lead portion provided continuously from a rear end of the linking portion (for example, see Japanese Unexamined Patent Publication No. 2005-293970).

However, in the above-described conventional example, there is caused impedance mismatching between the adjacent contacts due to an offset between the upper and lower contacts 600*a* and 600*b*. Moreover, it is difficult to realize impedance matching at a high level, which is one of the major reasons for deterioration in transmission characteristics.

With the upper and lower contacts 600*a* and 600*b*, in a case where, as indicated in FIG. 12, each width of the main portions is set to 0.7 mm, a pitch distance between the adjacent main portions is set to 1 mm, the offset between upper and lower levels is set to 0.5 mm, and each width of the linking portions and the lead portions is set to 0.2 mm, then a pitch distance between the adjacent lead portions is equal to 0.5 mm. However, the upper contacts 600*a* are spaced apart from adjacent contacts 600*a* at a distance of 1 mm in particular portions from points where the linking portions of the upper contacts 600*a* are led out of the rear face of the body 500 and are bent at a substantially right angle to extend downwards to points where the linking portions of the upper contacts 600*a* are aligned in parallel with the linking portions of the lower contacts 600*b*.

As described above, the distance between the adjacent contacts led out of the rear face of the body 500 is not entirely set to 0.5 mm but is partially set to 1 mm. Increased distance between the adjacent contacts causes decrease in electrostatic capacitance and increase in impedance. Another factor to decrease in electrostatic capacitance is that the linking portions of the upper contacts 600*a* are longer than the linking portions of the lower contacts 600*b* by the distance between levels of the upper contact 600*a* and the lower contact 600*b*, and that the upper contact 600*a* thus have larger areas that are not covered with the dielectric body 500 but are exposed to air.

As a result, the upper contacts 600*a* have larger impedances than those of the lower contacts 600*b*. Depending on the arrangement etc. of the contacts, the upper contacts 600*a* may have impedances significantly exceeding a predetermined standard value. Moreover, it is not easy to match impedances with high accuracy within a differential pair or between differential pairs. Such a problem is not unique to electric connectors of differential type but is also applicable to electric connectors of unbalanced type.

SUMMARY OF THE INVENTION

The present invention has been made in view of the above-described backgrounds. An object of the invention is to provide an electric connector enabling impedance matching with high accuracy, irrespective of an offset between different levels of contact groups.

According to the present invention, the electric connector includes: an insulating body in a shape adapted to be engaged on a front face thereof with an mating connector, the body having terminal receiving holes aligned in a widthwise direction thereof at an equal pitch distance in a plurality of levels shifted in phase and spaced apart from one another in correspondence with contacts of the mating connector; a plurality of levels of contact groups, each including a plurality of contacts in substantially L-letter shapes with tip end sides thereof being received and retained in the terminal receiving holes in the body and base end sides thereof being disposed along a rear face of the body, lead portions at rear ends of the contacts being aligned in a line in the widthwise direction at a pitch distance t; and a dielectric spacer, disposed in a blank region in the vicinity of the terminal receiving holes in the rear face of the body, the blank region being defined by adjacent ones of the contacts with base end sides thereof spaced apart at a distance "n×t," the n being an integer not smaller than two.

As described above, the electric connector according to the present invention is configured such that the spacer is disposed in each blank region between adjacent contacts with base end sides thereof spaced apart at a distance "n×t". Accordingly, an electrostatic capacitance is increased between the adjacent contacts positioned on both sides of the blank region, resulting in reduction of impedance between the adjacent contacts. Further, a magnitude of the impedance can be easily controlled by changing the material for the spacer, the size thereof, etc. Therefore, irrespective of an offset in levels between upper contact group and lower contact group, it is possible to minimize variation in impedance and further provide impedance matching with high accuracy, resulting in improvement in transmission characteristics of the connector.

Each of the contacts included in the respective contact groups may have a contact point portion, contactable with one of the contacts of the mating connector in a state where the mating connector is engaged with the body; a main portion, provided continuously from a rear end of the contact point portion and receivable in one of the terminal receiving holes in the body; a linking portion, provided continuously from a rear end of the main portion and bent substantially orthogonally so as to follow the rear face of the body, the linking portion having a length different from that of a linking portion in a different level of contact group; and the lead portion, provided continuously from a rear end of the linking portion.

The electric connector according to the present invention may be configured, in addition to the above-described basic configuration, such that the plurality of levels of contact groups include positive signal contacts, negative signal contacts, and common ground contacts, for use in transmission of differential signals. Preferably, on a cross sectional plane perpendicular to a length direction of the contacts, the contact groups may be arranged such that a plurality of contact sets in triangular arrangement are disposed in a lateral direction of the electric connector with respective vertical positional relationships of the sets turned upside down alternately, each of the contact sets being made up by one of the positive signal contacts and one of the negative signal contacts disposed at the bottom side of the triangular arrangement and one of the common ground contacts disposed at the apex.

As described above, in the electric connector according to the present invention, relative positional relations are equal to each other within a differential pair as well as between differential pairs. Therefore, impedance matching is further realized, resulting in further improvement in the transmission characteristics of the connector.

In addition to the above-described basic configuration, the electric connector may be configured such that a rear end of the spacer is in contact with a rear face of the back cover of the shield cover.

It is preferable that the spacer is made of a material having a relative permittivity larger than that of a material for the body.

The electrical connector may further include a metal shield cover of such a cylindrical shape as to surround an outer face of the body, the shield cover having a back cover. The shield cover may be contactable with an outer peripheral shield of the mating connector in a state where the mating connector is engaged with the body.

As described above, the electric connector of the invention is configured such that the spacer electrically insulates between the contact groups led out of the rear face of the body and the back cover of the shield cover. Accordingly, in addition to the above-described effects, it is possible to reduce the distance between the shield cover and the contacts without degrading in voltage resistance characteristics. Reduction in the distance therebetween contributes not only to downsizing of the entire connector but also to increase in electrostatic capacitance of the entire contacts, resulting in decrease in impedance on this aspect. Therefore, further improvement is realized in the transmission characteristics of the connector.

The electric connector of the invention may be configured, in addition to the above-described basic configuration, such that the spacer has: a base part of a plate shape, disposed to face the rear face of the body; and a projecting part, formed on the base part and adapted to be disposed in the blank region, the projecting part being receivable in a clearance between the adjacent contacts that are led out of the rear face of the body.

As described above, in the electric connector of the invention, even in a case where the tip ends of the contacts are subject to such a backward force as to drop the contacts out of the terminal insertion holes of the body when the mating connector is engaged with the body, the base ends of the contacts are brought into abutment the base part of the spacer. Therefore, in addition to the above-described effects, the contacts are more unlikely to be dropped off. Further, the spacer is interposed between the base ends of the contacts and the shield cover, so that the contacts are prevented from being brought into contact with the shield cover and causing electric short-circuiting. The connector can be improved in performance also in these aspects.

The base part of the spacer is preferably attachable onto the rear face of the body.

BRIEF DESCRIPTION OF THE DRAWINGS

FIGS. 9A and 9B are partially enlarged views of a convex part of the body of the electric connector, while FIG. 9A is a view from a front side and FIG. 9B is a view from a rear side;

DETAILED DESCRIPTION OF THE PREFERRED EMBODIMENTS

Figure 1:
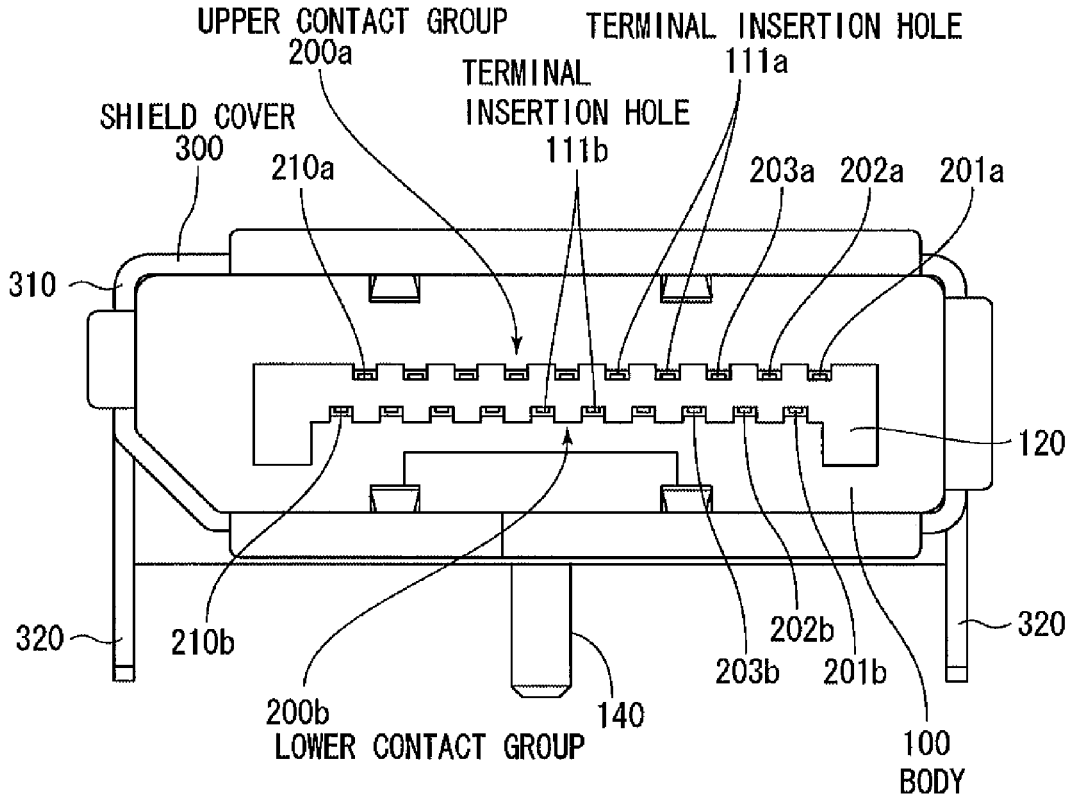
FIG. 1 is a front elevational view illustrating an electric connector according to an embodiment of the present invention.

Description is given below to embodiments of the present invention with reference to FIGS. 1 to 11 and 13.

The electric connector described herein is of a board mount type dealing with differential transmission at a high speed. As shown in FIGS. 1 to 6, the electric connector includes a body 100 formed with terminal receiving holes 111*a* and 111*b*, upper and lower contact groups 200*a* and 200*b* press fitted into the respective terminal receiving holes 111*a* and 111*b*, a shield cover 300 surrounding an outer periphery of the body 100, and a spacer 400 attached to a rear face of the body 100. The upper and lower contact groups 200*a* and 200*b* are led out of the rear face of the body 100 toward rear ends, particularly lead portions 2014*a*, 2014*b*, and other portions. These portions of the contact groups 200*a* and 200*b* are aligned at a pitch distance t along a width of the body.

The body 100 is formed by injection-molding synthetic resin for general use such as PBT (polybutylene terephthalate) or PPS (polyphenylene sulfide). The body 100 has a shape adapted to be fitted at a front side thereof with a mating connector A, as shown in FIG. 4.

The body 100 has a main part 110 in a substantially rectangular solid shape being provided at a center thereof, with the terminal receiving holes 111*a* and 111*b* extending from a front face to the rear face thereof, a projecting part 120 in a substantially thin rectangular solid shape formed on a front side of the main part 110 and adapted to be fitted into a concavity at a distal end of the mating connector A, a base part 130 in a substantially plate shape provided under the main part 110 and extended forwards so as to support a bottom of the mating connector A, and a positioning boss 140 in a column shape projecting downwards from a bottom of the base part 130 so as to correspond to a positioning hole provided in an external board (not shown).

The main part 110 is provided on the front side thereof with the terminal receiving holes 111*a* and 111*b*, which are lined at equal pitch distances in a widthwise direction of the electric connector in two rows and shifted in phase one row from another with spacing in between. The terminal insertion holes 111*a* and 111*b* are identical horizontally elongated rectangular through holes, provided ten in each row so as to correspond to main portions 2012*a*, 2012*b* of the upper and lower contact groups 200*a* and 200*b*.

Figure 4:
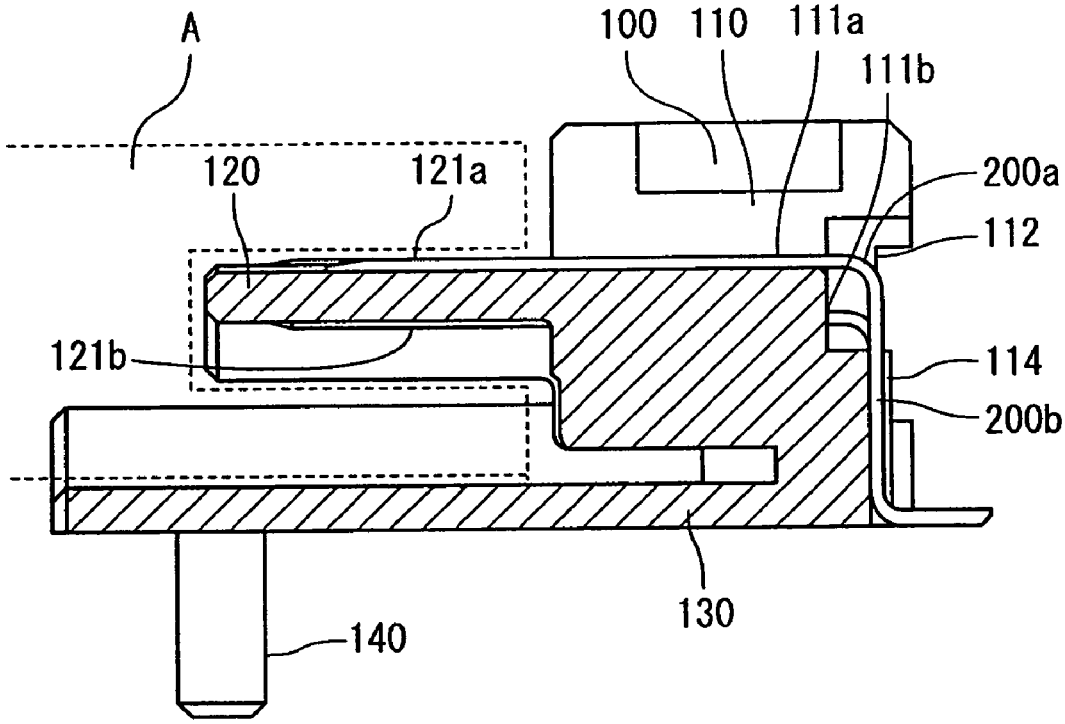
FIG. 4 is a side elevational view of the electric connector in a state where a shield cover is removed.
Figure 6:
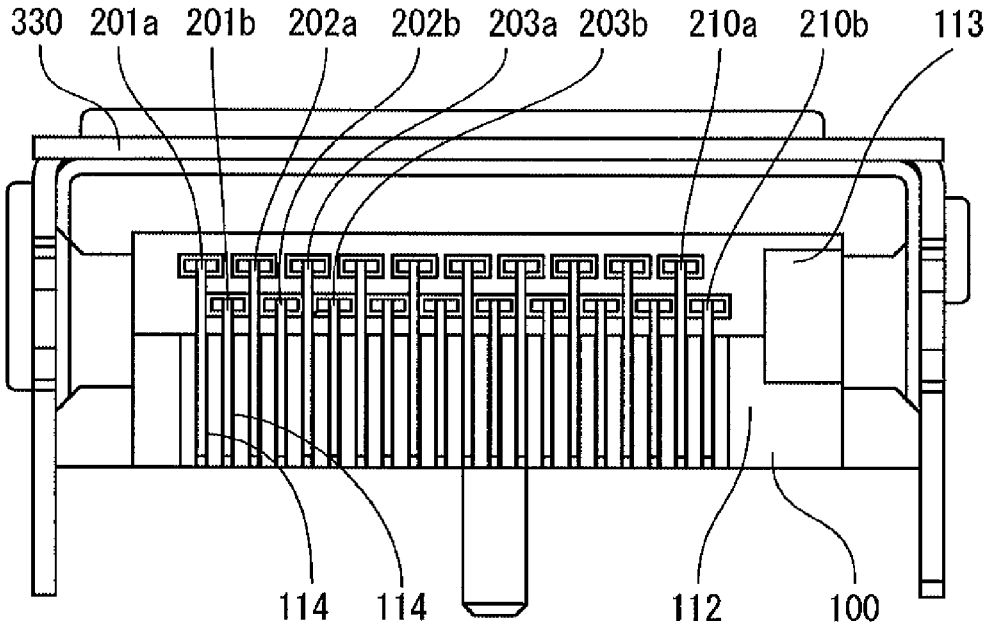
FIG. 6 is a rear elevational view of the electric connector in a state where the back cover of the shield cover is opened and a spacer is removed from a body.
Figure 7:
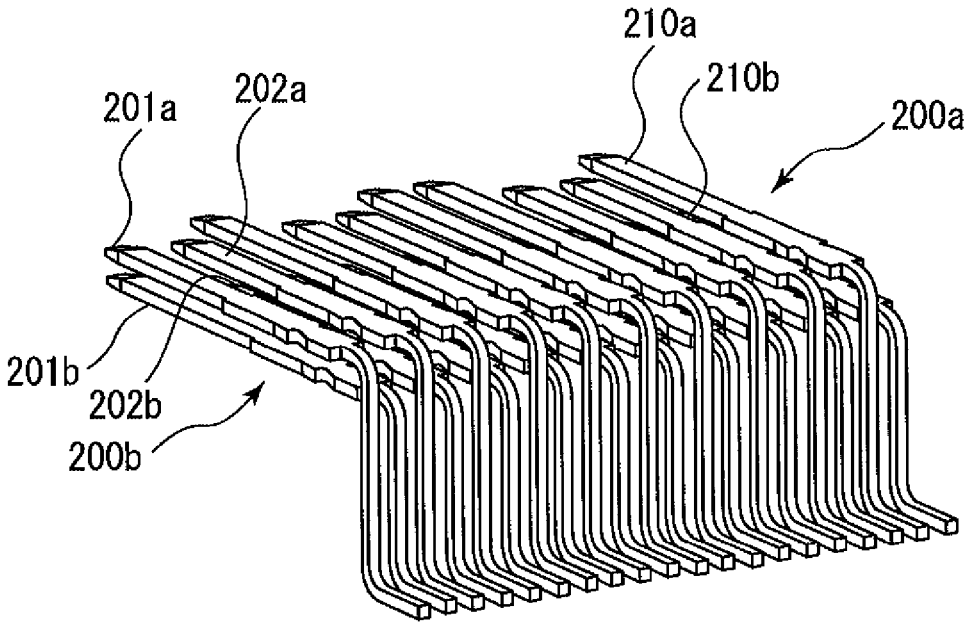
FIG. 7 is a perspective view illustrating arrangement and the like of contact groups of the electric connector.

As shown in FIGS. 4 and 6, the main part 110 is formed on a rear face thereof with a cutout 112 for fitting the spacer 400. In a back face of the cutout 112, there are formed with grooves 114 extending linearly downwards below the terminal insertion holes 111*a* and 111*b*. The grooves 114 each have a horizontal width corresponding to linking portions 2013*a*, 2013*b* of the upper and lower contact groups 200*a* and 200*b*, and are aligned in the widthwise direction at the pitch distance t. To the right, as viewed in FIG. 6, of the terminal insertion holes 111*a* and 111*b* provided on the bottom face of the cutout 112, a rectangular hole 113 is formed corresponding to an attaching part 430 of the spacer 400.

Figure 9:
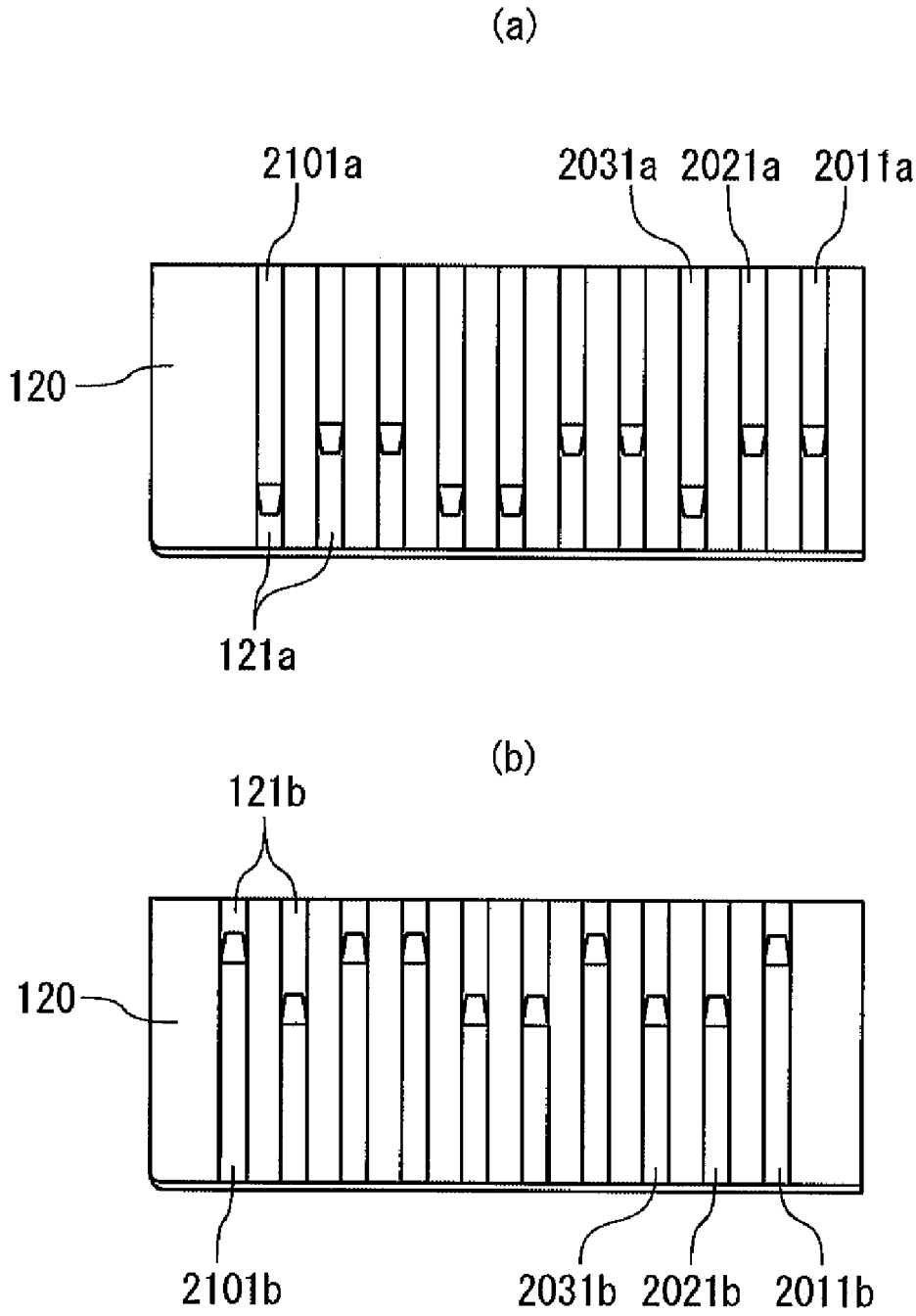

As shown in FIGS. 4 and 9(*a*), in an upper surface of the projecting portion 120 of the body 100, there are provided with grooves 121*a* communicating with the terminal insertion holes 111*a* in the main portion 110 and extending in straight lines in a longitudinal direction of the body 100. In the lower surface of the projecting portion 120, as shown in FIGS. 4 and 9(*b*), there are provided with grooves 121*b* communicating with the terminal insertion holes 111*b* in the main portion 110 and extending in straight lines in the longitudinal direction of the body 100. The terminal guide grooves 121*a* and 121*b* correspond in lateral width to contact portions 2011*a* and 2011*b* of the upper and lower contact groups 200*a* and 200*b*. The terminal guide grooves 121*a* and 121*b* are shifted from each other in phase in the lateral direction, in a similar manner to the terminal insertion holes 111*a* and 111*b*.

Figure 8:
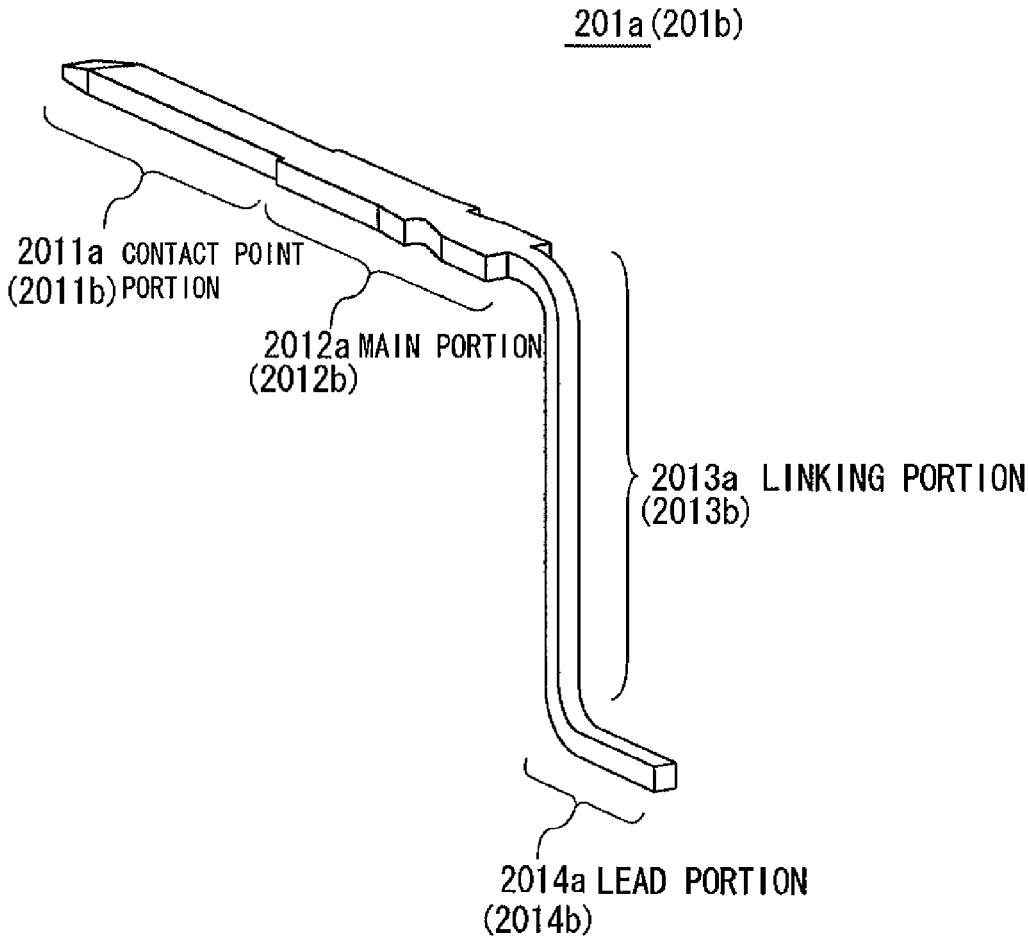
FIG. 8 is a perspective view of a contact of the electric connector.

According to the present embodiment, the upper contact group 200*a* consists of contacts 201*a* to 210*a* as shown in FIGS. 1 and 6. As shown in FIGS. 4 and 8, each of the contacts 201*a* to 210*a* is a terminal in a substantially L-letter shape. A tip end side of each contact is received and retained in one of the terminal insertion holes 111*a* in the body 100, while a base end side of the contact is disposed along the rear face of the body 100.

Specifically, the tip end side of each contact 201*a* is made up of the contact point portion 2011*a* and the main portion 2012*a* that is provided continuously from a rear end of the contact point portion 2011*a* and inserted into one of the terminal insertion holes 111*a* in the body 100. The base end side of each contact 201*a* is made up of the linking portion 2013*a*, provided continuously from a rear end of the main portion 2012*a* and bent at a substantially right angle so as to extend along the rear face of the body 100, and the lead portion 2014*a*, provided continuously from a rear end of the linking portion 2013*a* and bent at a substantially right angle.

On the other hand, as shown in FIGS. 1 and 6, the lower contact group 200*b* consists of contacts 201*b* to 210*b*. As shown in FIGS. 4 and 8, each of the contacts 201*b* to 210*b* is a terminal in a substantially L-letter shape. A tip end side of each contact is received and retained in one of the terminal insertion holes 111*b* in the body 100, while a base end side of the contact is disposed along the rear face of the body 100.

Specifically, the tip end side of each contact 201*b* is made up of the contact point portion 2011*b* and the main portion 2012*b* that is provided continuously from a rear end of the contact point portion 2011*b* and inserted into one of the terminal insertion holes 111*b* in the body 100. The base end side of each contact 201*b* is made up of the linking portion 2013*b*, provided continuously from a rear end of the main portion 2012*b* and bent at a substantially right angle so as to extend along the rear face of the body 100, and the lead portion 2014*b*, provided continuously from a rear end of the linking portion 2013*b* and be bent at a substantially right angle.

The contact point portions 2011*a* and 2011*b* of the contacts 201*a*, 201*b* are contactable with contacts (not shown) of the mating connector A as engaged with the body 100.

The contact 201*a* is different from the contact 201*b* in that the linking portion 2013*a* is longer than the linking portion 2013*b* by the distance in levels between the upper and lower contact groups 200*a* and 200*b*. Moreover, the contact point portion 2011*a* and the contact point portion 2011*b* are also different from each other in length, but the details of the difference is to be described later.

When the contact 201*a* is press fitted into an associated one of the terminal insertion holes 111*a* in the body 100 from the rear side, the contact point portion 2011*a* is received in the associated groove 121*a* in the body 100, the main portion 2012*a* is received in the associated terminal insertion holes 111*a* in the body 100, and the linking portion 2013*a* is received in the associated groove 114 in the body 100, and these parts are respectively retained in this state. On the other hand, when the contact 201*b* is press fitted into an associated one of the terminal insertion holes 111*b* in the body 100 from the rear side, the contact point portion 2011*b* is received in the associated groove 121*b* in the body 100, the main portion 2012*b* is received in the associated terminal insertion hole 111*b* in the body 100, and the linking portion 2013*b* is received in the associated groove 114 in the body 100, and these parts are respectively retained in this state. The lead portion 2014*a* of the contact 201*a* and the lead portion 2014*b* of the contact 201*b* are aligned with each other in the widthwise direction, and are located at a height identical to the bottom face of the base part 130 of the body 100 as shown in FIG. 4.

Since the contacts 202*a* to 210*a* are configured similarly to the contact 201*a* and the contacts 202*b* to 210*b* are configured similarly to the contact 201*b*, description thereof will not be repeated herein.

Figure 11:
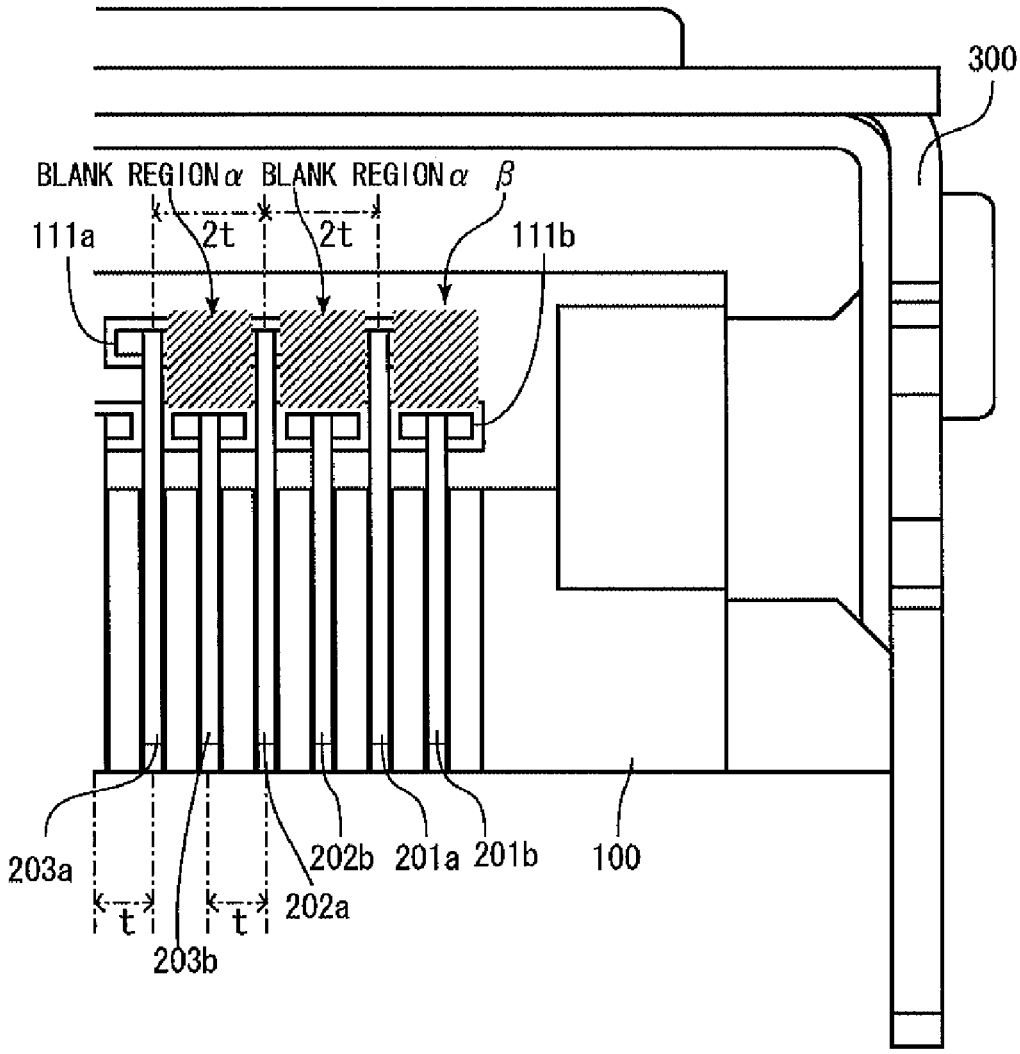
FIG. 11 is a partially enlarged view of FIG. 6, and also illustrating positions and the like of blank regions and an end region provided among the respective adjacent contacts led out of a rear face of the body.
Figure 12:
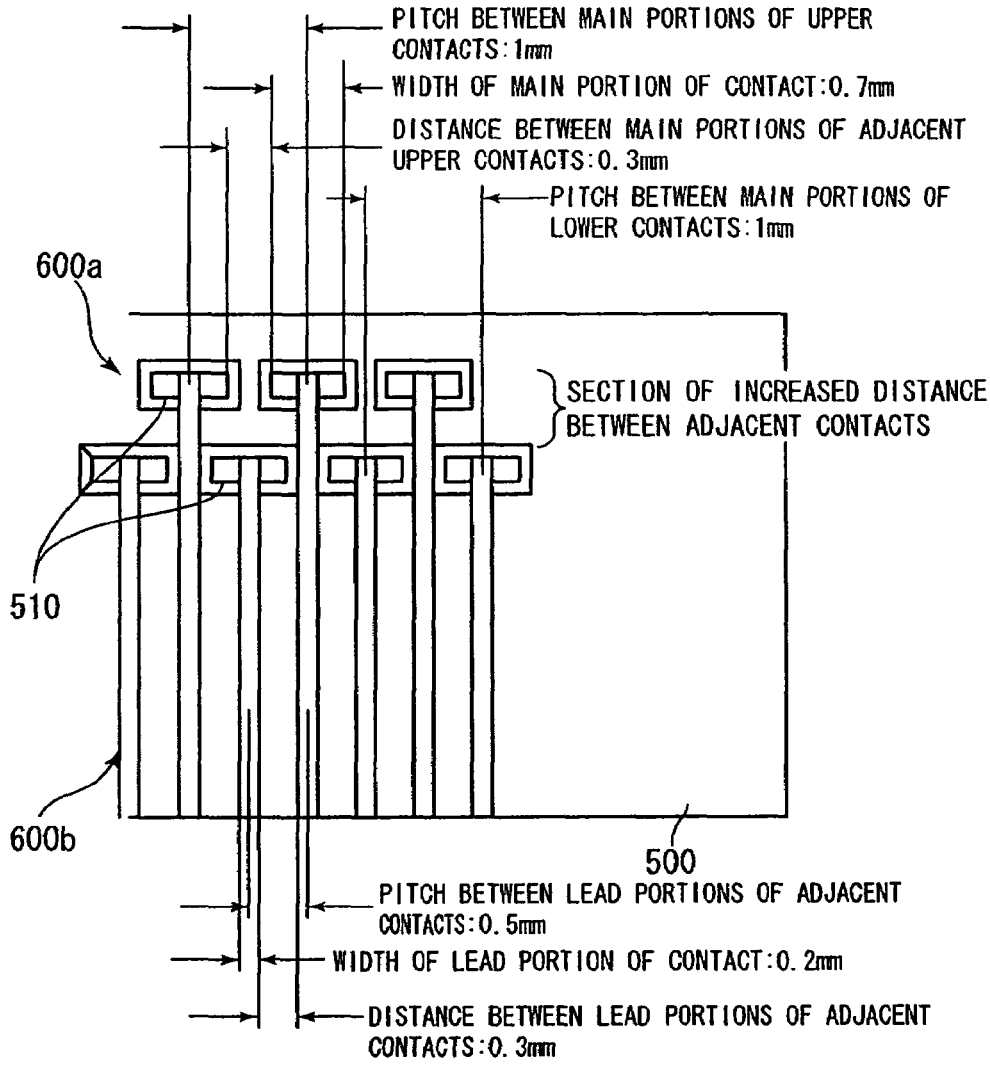
Fig. 12 PRIOR ART
FIG. 12 is a view of a conventional electric connector, illustrating alignment and the like of contact groups led out of a rear face of a body.

In a state where the upper and lower contact groups 200*a* and 200*b* are attached respectively to the body 100 as described above, the lead portions 2014*a* and 2014*b* etc. of the upper and lower contact groups 200*a* and 200*b* are aligned at the pitch distance t as shown in FIG. 11. The contacts 201*a* to 210*a* in the upper contact group 200*a* are spaced apart at their base end sides (bent portions of the linking portions

2013*a*) from the adjacent contacts at a distance "2×t," (n=2 in this case). Between each two adjacent contacts 201*a* to 210*a* and in the vicinity of the terminal insertion holes 111*a* and 111*b* in the rear face of the body 100, there exist a blank region α. In addition, there exist an end region β at either end of the upper and lower contact groups 200*a* and 200*b*. It should be noted that FIG. 11 illustrates only the blank region α between the contact 201*a* and the contact 202*a*, the blank region α between the contact 202*a* and the contact 203*a*, and the end region β on a side of the contact 201*a*.

The electric connector according to the present embodiment is used as a power source line and also used for transmission of single end signals and first to fifth differential signals. The upper and lower contact groups 200*a* and 200*b* consists of the contacts (207*a*, 210*a*, 207*b*, 209*b* and 210*b*) to be used as a power source line and in transmission of and single-ended signals, the contacts (201*a*, 202*b*, 205*a*, 205*b* and 208*a*) for plus signals to be used in transmission of first to fifth differential signals, the contacts (202*a*, 204*a*, 203*b*, 206*b* and 209*a*) for minus signals, and the contacts (201*b*, 203*a*, 204*b*, 206*a* and 208*b*) for common grounds.

Among the upper and lower groups of contacts 200*a* and 200*b*, of special note are the contacts 201*a*-206*a*, 208*a*, 209*a*, 201*b*-206*b* and 208*b* for transmission of the first to fifth differential signals. As shown in FIG. 1, these contacts are disposed in five sets of triangular arrangements on a cross sectional plane of the body 100 perpendicular to the length direction of the contacts: each triangular set is formed by one positive signal contact and one negative signal contact disposed at the bottom side of the triangular arrangement and one common ground contact disposed at the apex. These five sets are sequentially arranged in the lateral direction of the body 100 with their vertical orientations alternately inverted.

In the electric connector in the present embodiment, the contacts for signal transmission and other use are arranged in the above-described relationship. Therefore, for the purpose of reducing a skew, etc. between adjacent contacts of each differential pair and between the differential pairs, the longitudinal relationship among the contact portions 2011*a*-2111*a* of the contacts 201*a*-210*a* and the contact portions 2011*b*-2111*b* of the contacts 201*b*-210*b* is established as shown in FIG. 9.

It should be noted that modification in design may be appropriately made to the shapes, lengths, number, arrangement, assignment of signaling functions, etc. of the respective contacts in accordance with a application target. Further, positional relationship may be switched between the positive signal contacts and the negative signal contacts.

Figure 2:
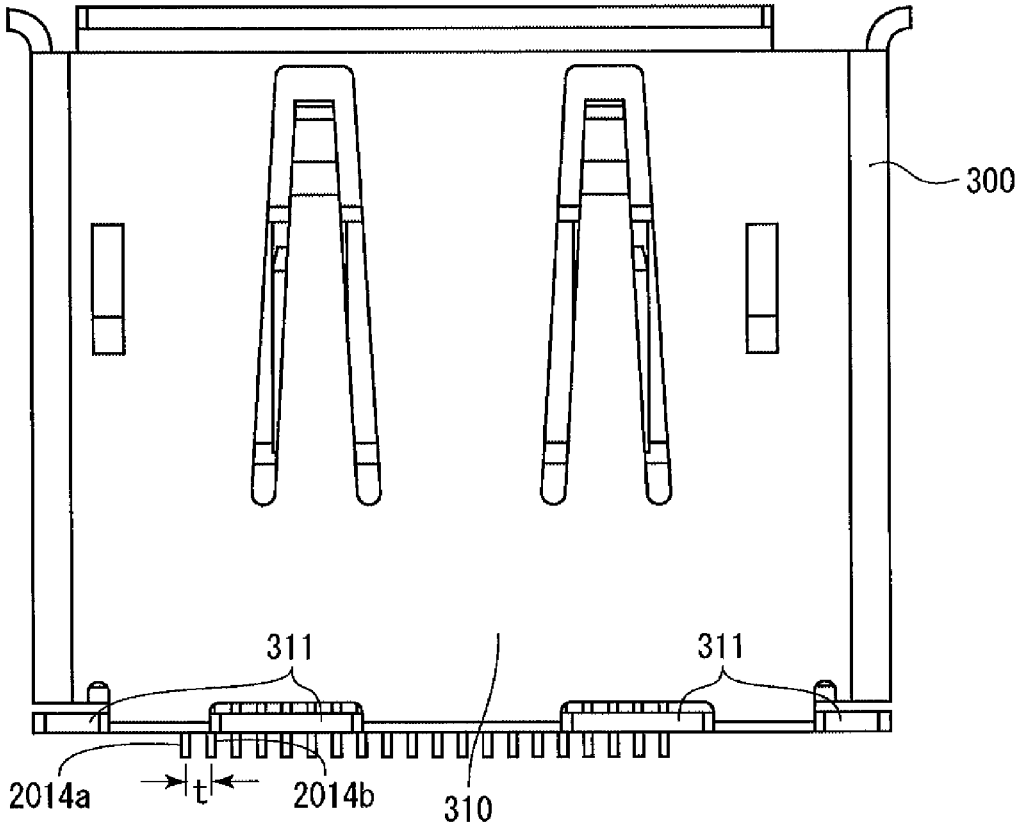
FIG. 2 is a top plan view of the electric connector.

The shield cover 300 is a metal shell which can be brought into contact with an outer peripheral shield (not shown) of the mating connector A as engaged with the body 100. Specifically, as shown in FIGS. 1 to 3, the shield cover 300 has a main part 310 in a rectangular frame shape with front and rear ends thereof opened surrounding the outer periphery of the body 100, a pair of legs 320 provided as piece members formed on opposite ends of a bottom face of the main part 310, in correspondence with mounting holes provided in an external circuit board (not shown), and a back cover 330 formed as a plate member provided on the rear side of the main part 310 for openably closing the open rear end of the body 100.

Figure 3:
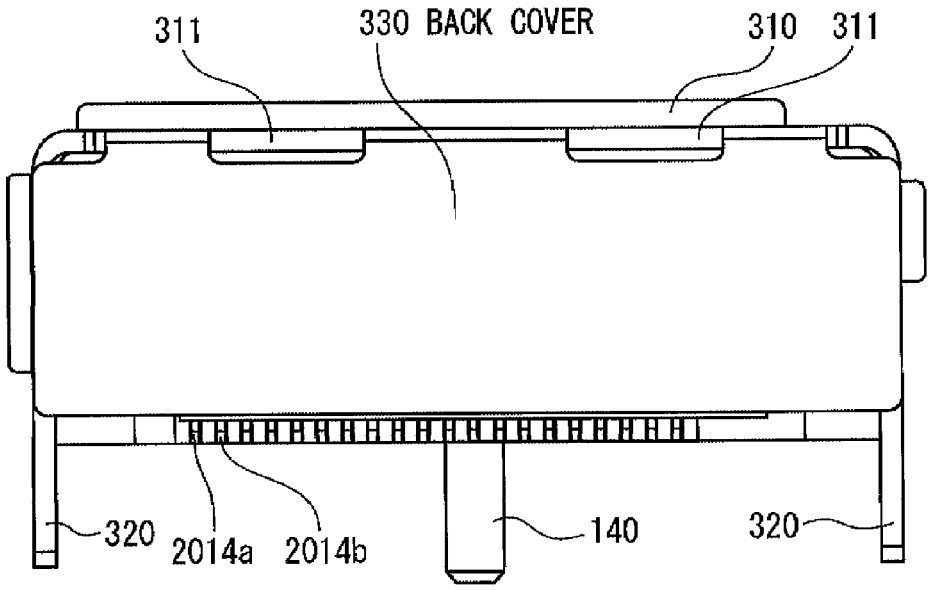
FIG. 3 is a rear elevational view of the electric connector.

As shown in FIG. 3, at the top of the main part 310 on the rear side thereof, there are provided pivotal support members 311 for retaining the back cover 330 in an opened or closed state.

Figure 5:
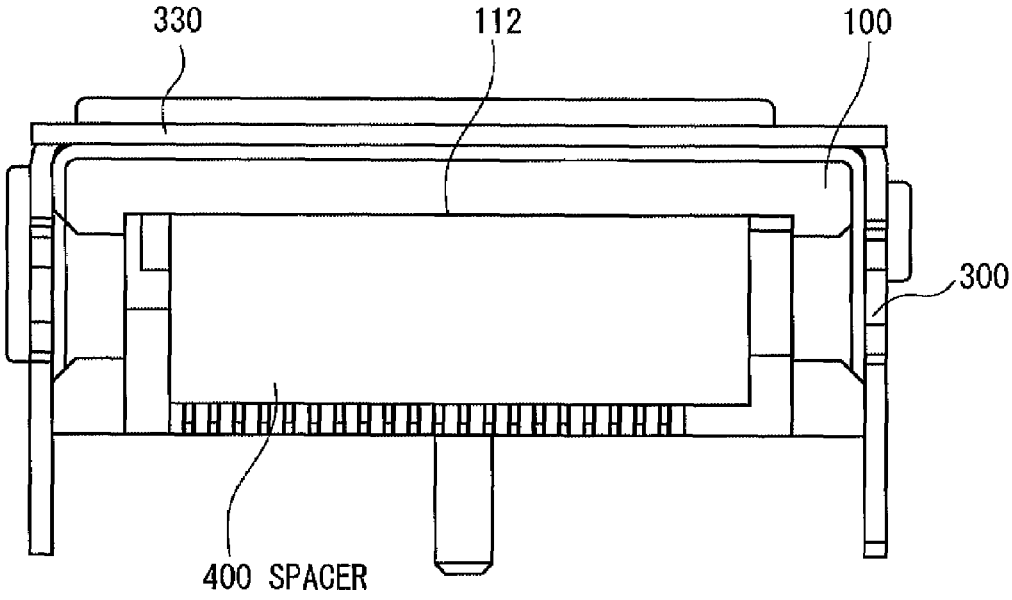
FIG. 5 is a rear elevational view of the electric connector in a state where a back cover of the shield cover is opened.
Figure 10:
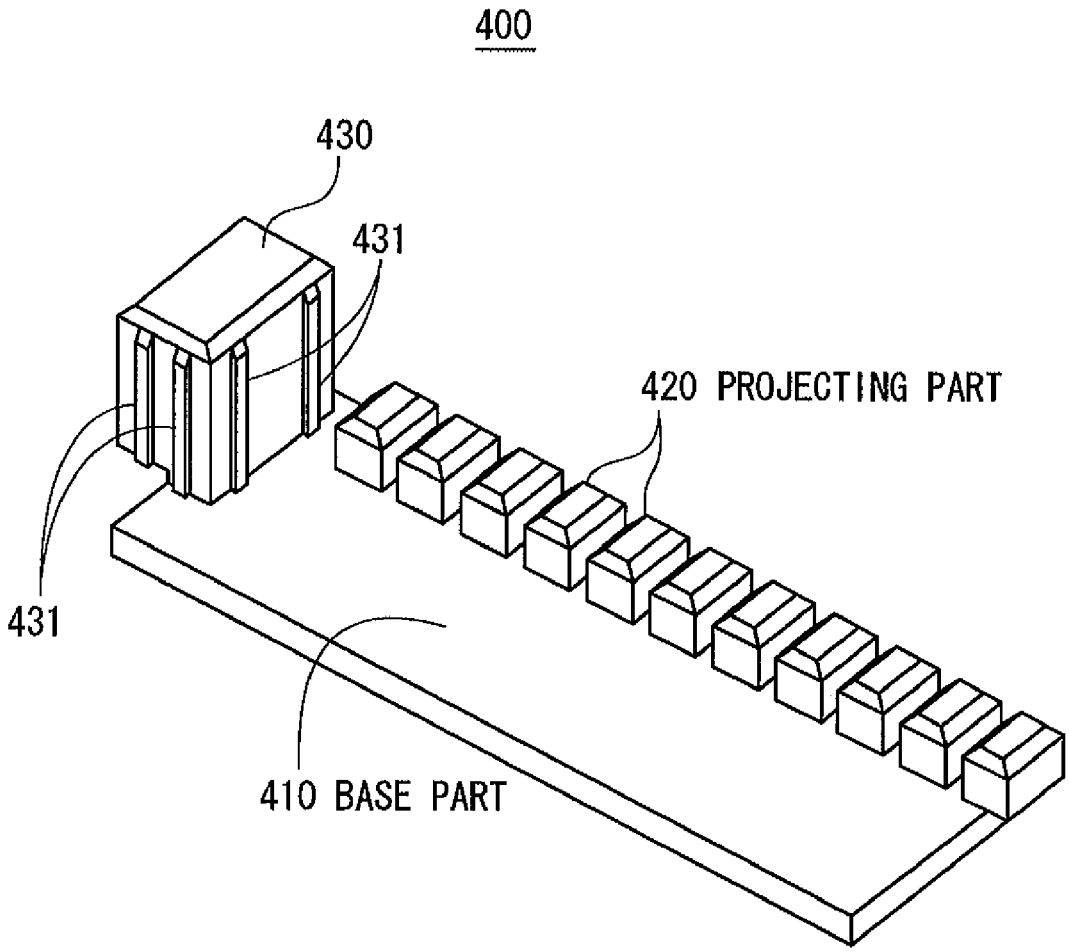
FIG. 10 is a perspective view of the spacer of the electric connector.

The spacer 400 of a plate shape is made of a dielectric plastics material and, as shown in FIGS. 5 and 10, has a base part 410, eleven projecting parts 420, and the attaching part 430 as shown in FIGS. 5 and 10. More particularly, the base part 410 is a plate member disposed to oppose the rear face of the body 100 and has an enough area to cover the linking portions 2013*a*, 2013*b* of the upper and lower contact groups 200*a* and 200*b* led out of the rear face of the body 100. The eleven projecting parts 420 are in substantially rectangular solid shapes and aligned on the base part 410, so as to be disposed respectively in the blank regions α and the end regions β. The attaching part 430 is in a substantially rectangular solid shape and is provided on one end of the base part 410.

The spacer 400 is made of a material, such as nylon, having a relative permittivity larger than that of the material of the body 100.

Each of the projecting parts 420 has a width slightly smaller than the space between the respective two adjacent contacts 201*a* to 210*a* in the upper contact group 200*a*. The attaching part 430 is provided on each side face thereof with retentive linear projections 431.

Specifically, when the attaching part 430 of the spacer 400 is inserted into the rectangular hole 113 in the body 100, the projections 431 formed on the attaching part 430 abut inner faces of the rectangular hole 113. By friction of the abutment, the spacer 400 is retained partly in the rectangular hole 113 and is generally mounted inside the cutout 112 of the body 100. In this state, the projecting parts 420 are received respectively in the clearances and on the opposite ends of the contacts 201*a* to 210*a*, that is, disposed in the blank regions α and the end regions β.

After the spacer 400 is attached onto the rear face of the body 100 and the back cover 330 of the shield cover 300 is closed, a back face of the base part 410 of the spacer 400 is brought into contact with a back face of the back cover 330. The lead portions 2014*a*, 2014*b*, and the like at the rear ends of the upper and lower contact groups 200*a* and 200*b* pass below the back cover 330 of the shield cover 300 to be led outside.

In the electric connector having the above-described configuration, the projecting parts 420 of the dielectric spacer 400 are respectively disposed in the blank regions α and the end regions β that are clearances between the contacts in the upper contact group 200*a* led out of the rear face of the body 100. This arrangement increases the electrostatic capacitances between each two of the contacts 201*a* to 210*a* that are disposed on opposite sides of the respective blank regions α, and accordingly the impedance is decreased. The magnitude of the impedance can be easily controlled by changing the material of the spacer 400 or the size, shape and the like of each of the projecting parts 420.

In addition, the spacer 400 electrically insulates the upper and lower contact groups 200*a* and 200*b*, which are led out of the rear face of the body 100, from the back cover 330 of the shield cover 300. As a result, it is possible to reduce the distance between the shield cover 300 and the base ends of the upper and lower contact groups 200*a* and 200*b*, without degradation of voltage resistance characteristics. Reduced distance therebetween enables not only downsizing of the entire connector but also increase in electrostatic capacitance between the respective contacts, presumably leading to decrease in impedance in this respect.

Moreover, the relative positional relations are equalized within each differential pair and between the differential pairs because of the above-described arrangements among the contacts (201*a*, 202*b*, 205*a*, 205*b* and 208*a*) for plus signals to be used in transmission of first to fifth differential signals, the contacts (202*a*, 204*a*, 203*b*, 206*b* and 209*a*) for minus signals, and the contacts (201*b*, 203*a*, 204*b*, 206*a* and 208*b*) for common grounds.

Therefore, variation in impedance can be suppressed irrespective of the offset in levels between the upper contact group 200*a* and the lower contact group 200*b*. In other words, impedance matching is achieved at a high level within each differential pair and between the differential pairs, resulting in improved transmission characteristics of the connector.

When engaging the mating connector A with the body 100, the contact point portions 2011*a*, 2011*b*, etc. of the contacts 201*a*, 201*b*, etc. may be subject to such a backward force as to drop the contacts 201*a*, 201*b*, etc. out of the terminal insertion holes 111*a* and 111*b* of the body 100. Even in this case, the linking portions 2013*a* etc. of the contacts 201*a* etc. are brought into abutment against the base part 410 of the spacer 400. Therefore, the contact 201*a* etc. are more unlikely to be dropped off. Further, the spacer 400 is interposed between the linking portions 2013*a* etc. of the contacts 201*a* etc. and the back cover 330 of the shield cover 300, so that the contacts 201*a* etc. are prevented from being brought into contact with the shield cover 300 and causing electric short-circuiting. Also in these aspects, the connector can be improved in performance.

It should be noted that the electric connector according to the present invention is not limited to the above-described embodiment, or is not limited to a board mount type but is similarly applicable to a cable connection type. Further, the electric connector according to the present invention is not limited to a particular system of electric signal transmission, but is similarly applicable to a transmission system of unbalanced type.

The design of the body may be appropriately modified in terms of the shape and the material, as well as the number and arrangement of the terminal receiving holes, in accordance with an application target. The body may be in any design as long as it has a shape suitable to engage on the front side thereof with an mating connector, and as long as the body has terminal receiving holes aligned in the widthwise direction at an equal pitch distance in a plurality of rows that apart from one another and shifted in phase.

In the contact groups, the contacts may be in any shape as long as they are terminals of substantially L-letter shape, with the tip end sides adapted to be received and retained in of the terminal receiving holes in the body and the base end sides being disposed along the rear face of the body, and with the lead portions on the rear ends being aligned in one line in the widthwise direction at the pitch distance t.

Figure 13:
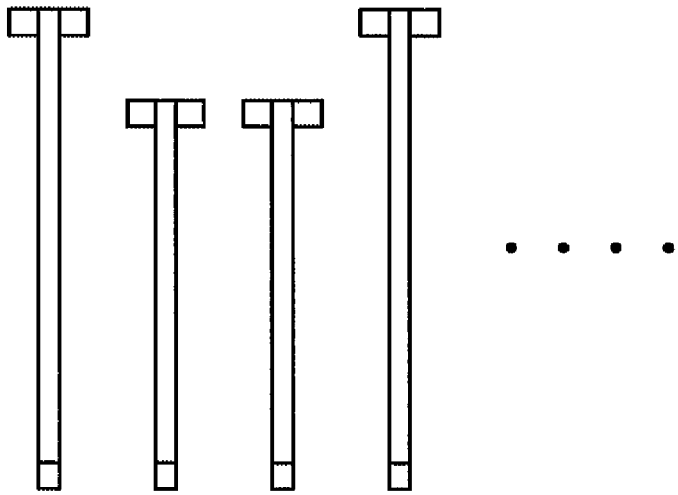
FIGS. 13(*a*) and 13(*b*) are views showing variations of the electric connector according to the embodiment of the present invention, schematically illustrating arrangement examples of the contact groups led out of the back face of the body of the connector.
Figure 13:
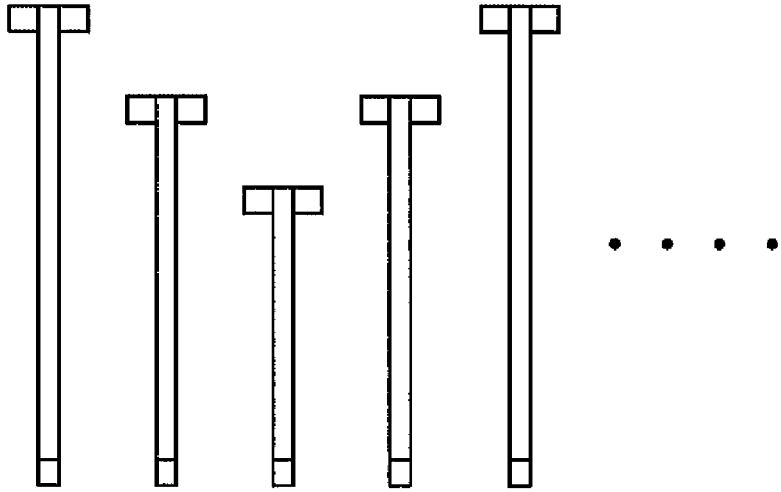

The spacer is not limited in terms of the shape or the way of attachment, etc., as long as it is a dielectric body which can be disposed in the blank regions in the vicinity of the terminal receiving holes in the rear face of the body, each region being defined by the adjacent contacts with base end sides thereof spaced apart at a distance "n×t (n: an integer not smaller than two)". In particular, depending on the number of levels of the contact groups or arrangement thereof, the distance between the adjacent contacts may be equal to "2×t (n=2)", "3×t (n=3, in case of the contact arrangement as shown in FIG. 13(*a*), for example)", "4×t (n=4, in case of the contact arrangement as shown in FIG. 13(*b*), for example", etc. and the present invention is similarly applicable to any of these cases. In application, the spacer may not be formed uniformly in terms of material, shape, thickness and the like, but may be formed differently in accordance with the variations in impedance between the respective adjacent contacts.

What is claimed is:

1. An electric connector comprising:

an insulating body in a shape adapted to be engaged on a front face thereof with a mating connector, the body having terminal receiving holes aligned in a widthwise direction thereof at an equal pitch distance in a plurality of levels shifted in phase and spaced apart from one another in correspondence with contacts of the mating connector;

a plurality of levels of contact groups, each including a plurality of contacts in substantially L-letter shapes with tip end sides thereof being received and retained in the terminal receiving holes in the body and base end sides thereof being disposed along a rear face of the body, and a dielectric spacer, wherein the base end sides of the contacts of the contact groups include lead portions at rear ends thereof and bent portions in generally L-shape, the lead portions of the contacts of the contact groups are aligned in a line in the widthwise direction at a pitch distance t, the bent portions of the contacts of the contact groups are located in the vicinity of the terminal receiving holes in the rear face of the body, of all the bent portions, adjacent bent portions in the widthwise direction are spaced apart from each other at a distance "n×t," the n being an integer not smaller than two, and space between the adjacent bent portions defines a blank region, and the dielectric spacer is disposed in the blank region.

2. The electric connector according to claim 1, wherein each of the contacts included in the respective contact groups has:

a contact point portion, contactable with one of the contacts of the mating connector in a state where the mating connector is engaged with the body;

a main portion, provided continuously from a rear end of the contact point portion and receivable in one of the terminal receiving holes in the body;

a linking portion, provided continuously from a rear end of the main portion and bent substantially orthogonally so as to follow the rear face of the body, the linking portion having a length different from that of a linking portion in a different level of contact group; and the lead portion, provided continuously from a rear end of the linking portion.

3. The electric connector according to claim 1, wherein the plurality of levels of contact groups include positive signal contacts, negative signal contacts, and common ground contacts, for use in transmission of differential signals, on a cross sectional plane perpendicular to a length direction of the contacts, the contact groups are arranged such that a plurality of contact sets in triangular arrangement are disposed in a lateral direction of the electric connector with respective vertical positional relationships of the sets turned upside down alternately, each of the contact sets being made up by one of the positive signal contacts and one of the negative signal contacts disposed at the bottom side of the triangular arrangement and one of the common ground contacts disposed at the apex.

4. The electric connector according to claim 1, wherein the spacer is made of a material having a relative permittivity larger than that of a material for the body.

5. The electric connector according to claim 1, further comprising a metal shield cover of such a cylindrical shape as to surround an outer face of the body, the shield cover having a back cover.

6. The electric connector according to claim 1, further comprising a metal shield cover of such a cylindrical shape as to surround an outer face of the body, the shield member having a back cover, wherein the shield cover is contactable with an outer peripheral shield of the mating connector in a state where the mating connector is engaged with the body.

7. The electric connector according to claim 5, wherein a rear end of the spacer is in contact with a back face of the back cover of the shield cover.

8. The electric connector according to claim 6, wherein a rear end of the spacer is in contact with a back face of the back cover of the shield cover.

9. A electric connector, comprising:

an insulating body in a shape adapted to be engaged on a front face thereof with a mating connector, the body having terminal receiving holes aligned in a widthwise direction thereof at an equal pitch distance in a plurality of levels shifted in phase and spaced apart from one another in correspondence with contacts of the mating connector:

a plurality of levels of contact groups, each including a plurality of contacts in substantially L-letter shapes with tip end sides thereof being received and retained in the terminal receiving holes in the body and base end sides thereof being disposed along a rear face of the body, lead portions at rear ends of the contacts being aligned in a line in the widthwise direction at a pitch distance t; and a dielectric spacer, disposed in a blank region in the vicinity of the terminal receiving holes in the rear face of the body, the blank region being defined by adjacent ones of the contacts with base end sides thereof spaced apart at a distance "n×t," the n being an integer not smaller than two, wherein the spacer comprises:

a base part of a plate shape, disposed to face the rear face of the body; and a projecting part, formed on the base part and adapted to be disposed in the blank region, the projecting part being receivable in a clearance between the adjacent contacts that are led out of the rear face of the body.

10. The electric connector according to claim 9, wherein the base part of the spacer is attachable onto the rear face of the body.

* * * * *